US007914321B2

(12) United States Patent
Huang

(10) Patent No.: US 7,914,321 B2
(45) Date of Patent: Mar. 29, 2011

(54) CONNECTOR FOR FLEXIBLE PRINTED CIRCUIT BOARD

(75) Inventor: Sheng-Yuan Huang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/507,797

(22) Filed: Jul. 23, 2009

(65) Prior Publication Data

US 2011/0021054 A1 Jan. 27, 2011

(51) Int. Cl.
*H01R 12/24* (2006.01)

(52) U.S. Cl. ..... 439/495; 439/260

(58) Field of Classification Search ..... 439/495, 439/67, 260, 329
See application file for complete search history.

(56) References Cited

U.S. PATENT DOCUMENTS

| | | | | |
|---|---|---|---|---|
| 7,029,320 | B2 * | 4/2006 | Maejima | 439/495 |
| 7,341,477 | B2 * | 3/2008 | Kato | 439/495 |
| 2001/0046804 | A1 * | 11/2001 | Fuchs et al. | 439/495 |
| 2005/0075004 | A1 * | 4/2005 | Endou et al. | 439/495 |
| 2008/0045076 | A1 * | 2/2008 | Dittmann et al. | 439/495 |
| 2008/0305669 | A1 * | 12/2008 | Hong et al. | 439/329 |

* cited by examiner

*Primary Examiner* — Hien Vu

(57) ABSTRACT

A connector adapted for receiving a flexible printed circuit board therein includes an insulating housing having a base board, a plurality of electric terminals disposed in the insulating housing and a shell slidably mounted onto the insulating housing. An end of the base board protrudes upward to form a preventing wall. A top of the preventing wall extends forward to form an elastic board. Each of the electric terminals has a base arm and an elastic arm. The base arm is disposed in the base board and the elastic arm is located under the elastic board. The flexible printed circuit board is inserted between the base arms and the elastic arms. The shell has a top board protruding downward to form at least one pressing portion slidably moving along the elastic board for pressing the elastic board downward so as to further press the elastic arms against the flexible printed circuit board.

17 Claims, 6 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to a connector for a flexible printed circuit (FPC hereinafter for simplification) board.

2. The Related Art

Referring to FIG. 9, a conventional FPC connector 7 adapted for receiving an FPC board (not shown) therein is shown. The FPC connector 7 includes an insulating housing 71 defining a mouth 711 in a front thereof, an actuator 72 pivoted to the mouth 711 of the insulating housing 71, and a plurality of electric terminals 73 disposed in the insulating housing 71. When the FPC connector 7 is in use, the actuator 72 will open rearward to make the FPC board be inserted rearward into the mouth 711 of the insulating housing 71 and electrically contact the electric terminals 73. Then the actuator 72 will close forward to be mounted into the mouth 711 to press the FPC board and ensure an electrical connection between the electric terminals 73 and the FPC board. However, the FPC board is held between the insulating housing 71 and the actuator 72 without any fixtures, so the FPC board may slide out of the mouth 711 when the FPC connector 7 is under shaking. As a result, the electrical connection between the FPC board and the electric terminals 73 is not steady.

SUMMARY OF THE INVENTION

An object of the present invention is to provide a connector adapted for receiving a longitudinally inserted flexible printed circuit board therein. The connector includes an insulating housing having a base board, a plurality of electric terminals disposed in the insulating housing in a transverse row and a shell slidably mounted onto the insulating housing along the insertion direction and withdrawal of the flexible printed circuit board. A rear end of the base board protrudes upward to form a preventing wall extending transversely. A top of the preventing wall extends forward to form an elastic board suspended over the base board with a receiving recess formed therebetween for receiving the flexible printed circuit board therein. Each of the electric terminals has a lying-U shaped base frame which has a lower arm defined as a base arm and an upper arm defined as an elastic arm. The base arm is disposed in the base board and the elastic arm stretches into the receiving recess under the elastic board. The flexible printed circuit board is inserted between the base arms and the elastic arms for electrically connecting the electric terminals. The shell has a top board. A portion of the top board protrudes downward to form at least one pressing portion slidably moving along the top surface of the elastic board from the preventing wall for pressing the elastic board downward so as to further press the elastic arms against the flexible printed circuit board.

As described above, the elastic board of the insulating housing is pressed downward by the pressing portion of the shell so as to further press the elastic arms against the flexible printed circuit board for ensuring a steady electrical connection between the flexible printed circuit board and the electric terminals.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
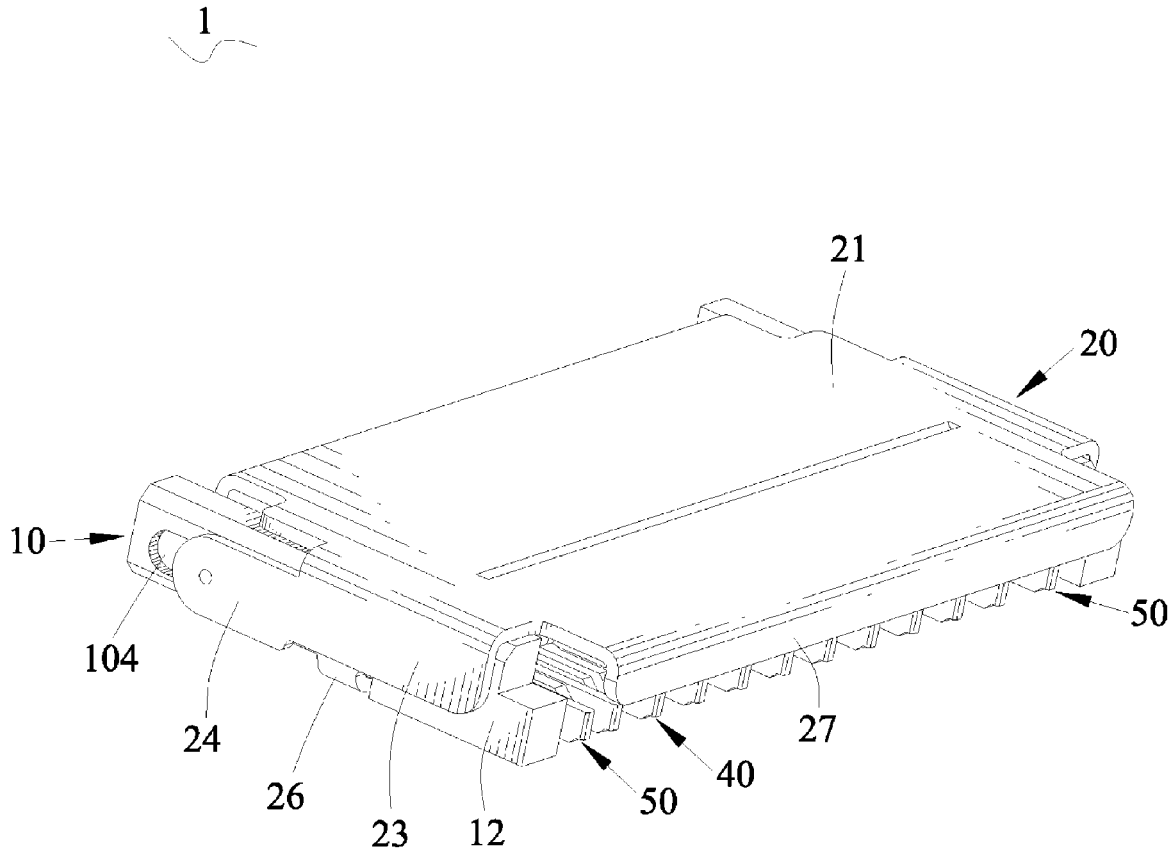
FIG. 1 is a perspective view of an FPC connector in accordance with the present invention.
Figure 2:
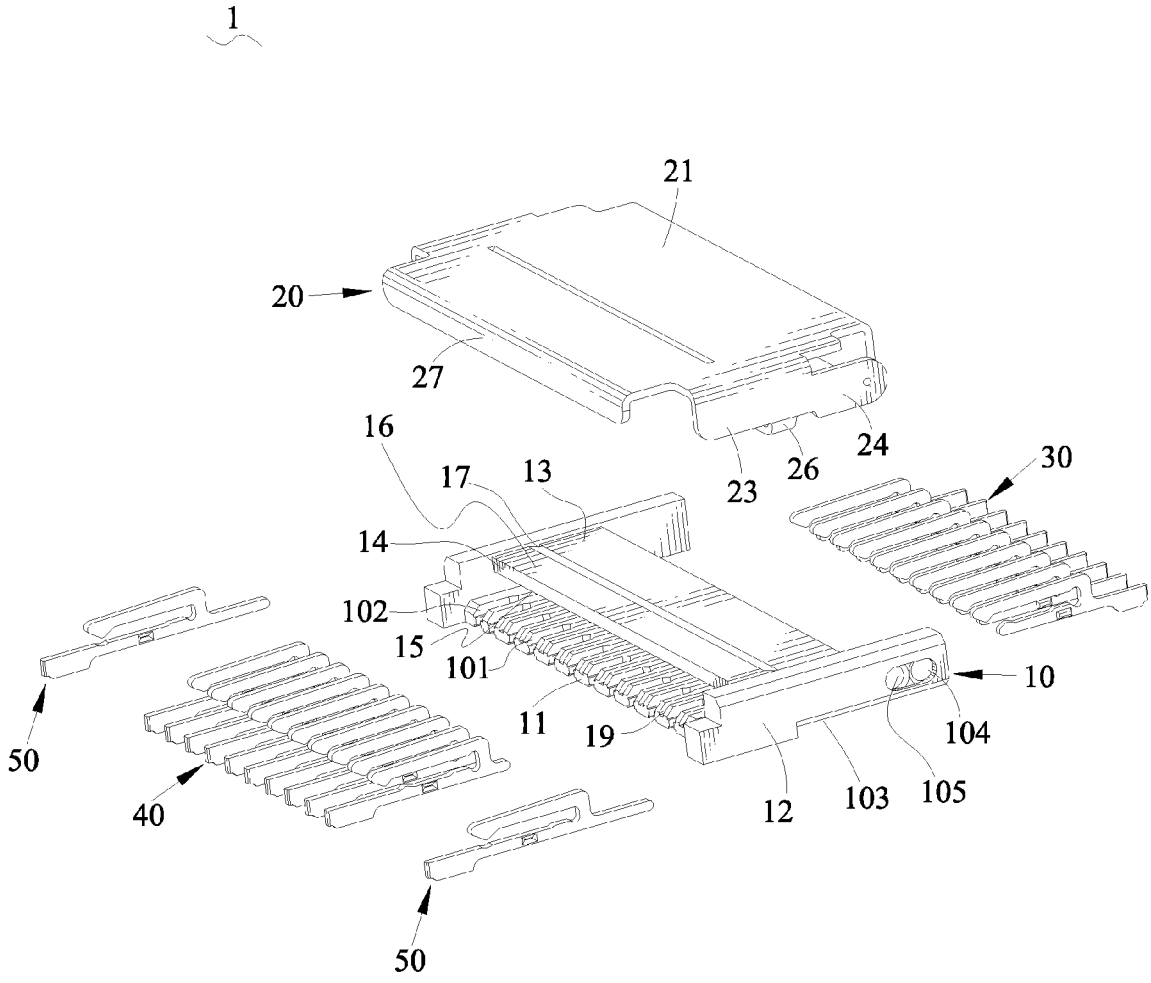
FIG. 2 is an exploded view of the FPC connector of FIG. 1.

Referring to FIG. 1 and FIG. 2, an FPC connector 1 in accordance with the present invention includes an insulating housing 10, a shell 20 mated onto the insulating housing 10, a plurality of first electric terminals 30, a plurality of second electric terminals 40 and two fastening members 50 disposed in the insulating housing 10 respectively.

Figure 5:
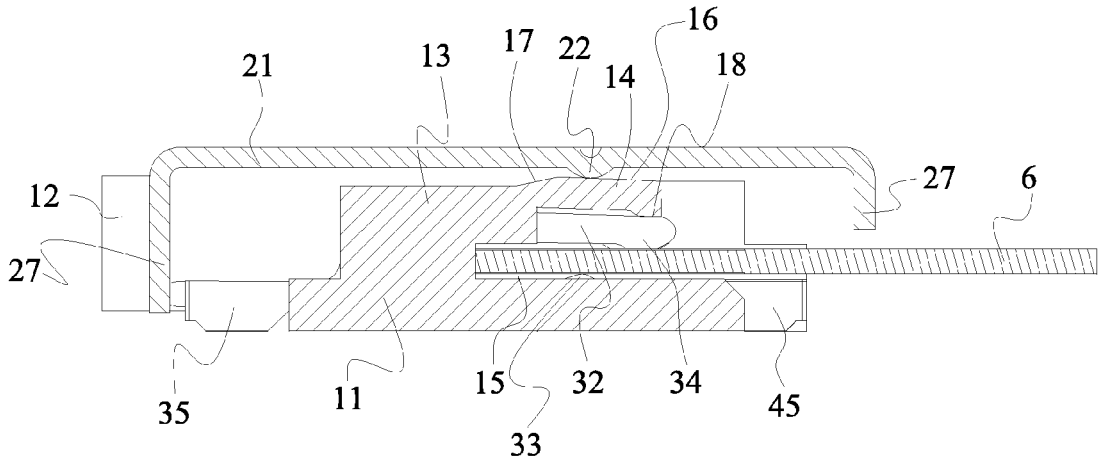
FIG. 5 is a cross-sectional view of the FPC connector with the FPC board of FIG. 4 along line V-V.

Referring to FIG. 2 and FIG. 5, the insulating housing 10 has a rectangular flat base board 11. Two opposite ends of the base board 11 protrude upward to form a pair of sidewalls 12 each extending longitudinally beyond a rear edge of the base board 11. A rear end of the base board 11 protrudes upward to form a preventing wall 13 extending transversely to be perpendicularly connected with the two sidewalls 12. A front end of a top of the preventing wall 13 extends forward to form an elastic board 14 suspended over the base board 11 and extending transversely to be adjacent to the two sidewalls 12. A receiving recess 15 is defined by the base board 11, the preventing wall 13, the elastic board 14 and the two sidewalls 12 for receiving an FPC board 6 therein. The elastic board 14 has a top surface 16 opposite to the base board 11 and higher than the preventing wall 13. A guiding slope 17 is formed to smoothly connect a top of the preventing wall 13 and the top surface 16 of the elastic board 14. A front edge of a bottom of the elastic board 14 protrudes downward to form a holding portion 18 extending transversely.

The base board 11 defines a plurality of first terminal passageways 19 and second terminal passageways 101 alternately arranged at regular intervals along a transverse direction thereof and communicating with the receiving recess 15. Each of the terminal passageways 19, 101 extends longitudinally to pass through the preventing wall 13. The outmost two of the terminal passageways 19, 101 are acted as two inserting grooves 102 each having the same structure as the second terminal passageway 101. A bottom of an outside of each of the sidewalls 12 defines an assisting channel 103 extending longitudinally to pass through a rear edge of the sidewall 12. A rear end of the outside of the sidewall 12 defines a first positioning groove 104 and a second positioning groove 105 adjacent to and in front of the first positioning groove 104.

Figure 3:
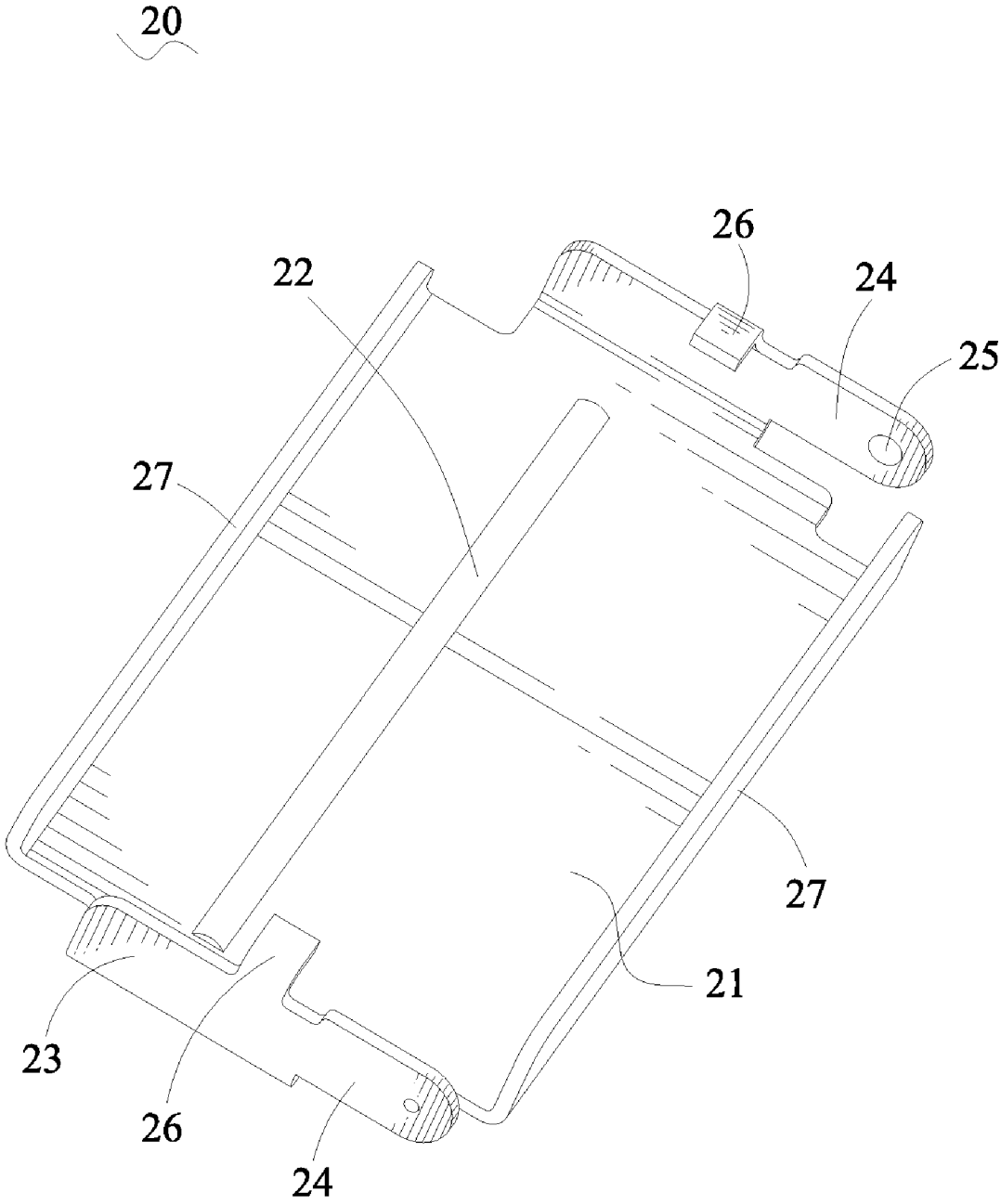
FIG. 3 is a perspective view of a shell of the FPC connector of FIG. 1.
Figure 4:
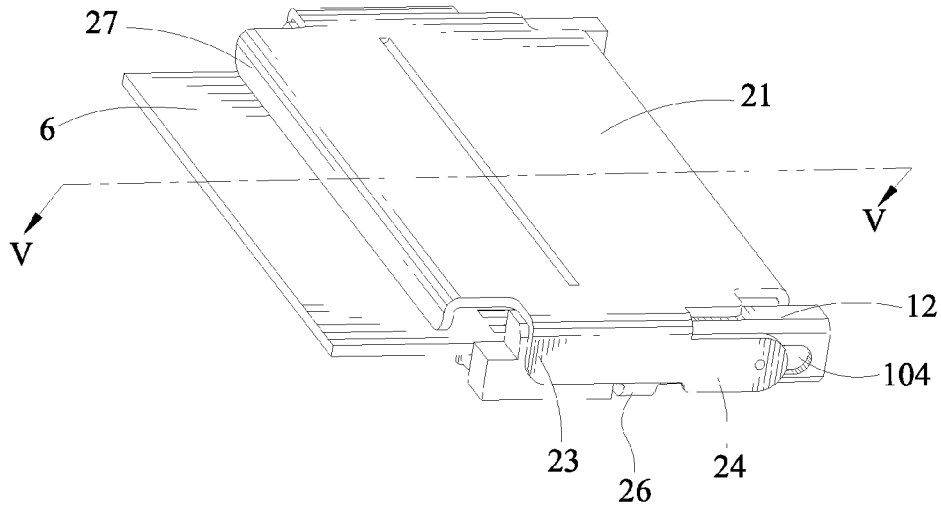
FIG. 4 is a perspective view of the FPC connector of FIG. 1, in which an FPC board is inserted.

Referring to FIG. 2 and FIG. 3, the shell 20 has a rectangular flat top board 21. A middle of a front of the top board 21 protrudes downward to form a pressing rib 22 extending transversely. Two opposite end edges of the top board 21 extend downward to form a pair of sideboards 23 each having a free rear end disconnected with the top board 21 and defined as an elastic piece 24. A rear end of each of the elastic pieces 24 protrudes inward to form a positioning lump 25. A portion of a bottom edge of each of the sideboards 23 extends downward and then is bent inward to form a buckling portion 26 substantially adjacent to the elastic piece 24. Both a rear edge and a front edge of the top board 21 extend downward to form a pair of preventing boards 27.

Figure 6:
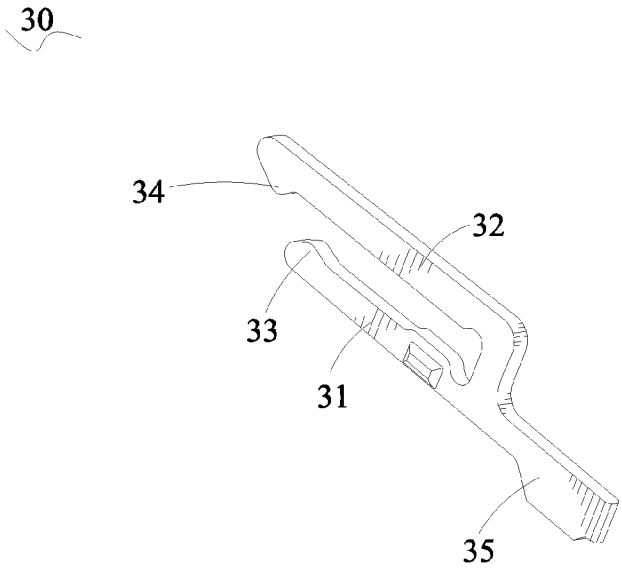
FIG. 6 is a perspective view of a first electric terminal of the FPC connector of FIG. 2.

Referring to FIG. 2 and FIG. 6, each of the first electric terminals 30 has a substantially lying-U shaped base frame which has a lower arm defined as a first base arm 31 and an upper arm defined as a first elastic arm 32 slightly longer than the first base arm 31. A free end of the first base arm 31 protrudes toward the first elastic arm 32 to form a first interference portion 33, and a free end of the first elastic arm 32 protrudes downward to form a first contact portion 34. The first base arm 31 further extends toward an opposite direction to the base frame and then is protruded downward to form a first soldering portion 35.

Figure 7:
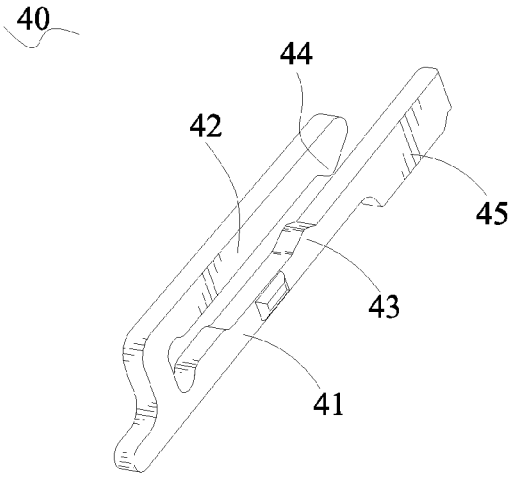
FIG. 7 is a perspective view of a second electric terminal of the FPC connector of FIG. 2.

Referring to FIG. 2 and FIG. 7, each of the second electric terminals 40 has a substantially lying-U shaped base frame which has a lower arm defined as a second base arm 41 and an upper arm defined as a second elastic arm 42 shorter than the second base arm 41. A substantial middle of the second base arm 41 protrudes toward the second elastic arm 42 to form a second interference portion 43, and a free end of the second elastic arm 42 protrudes toward the second base arm 41 to form a second contact portion 44. A free end of the second base arm 41 is protruded toward an opposite direction to the second interference portion 43 to form a second soldering portion 45.

Figure 8:
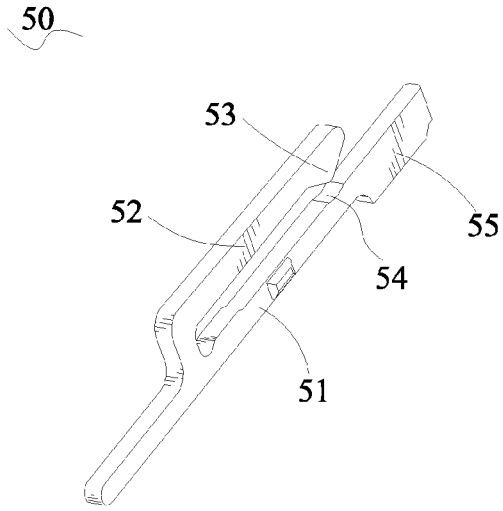
FIG. 8 is a perspective view of a fastening member of the FPC connector of FIG. 2.
Figure 9:
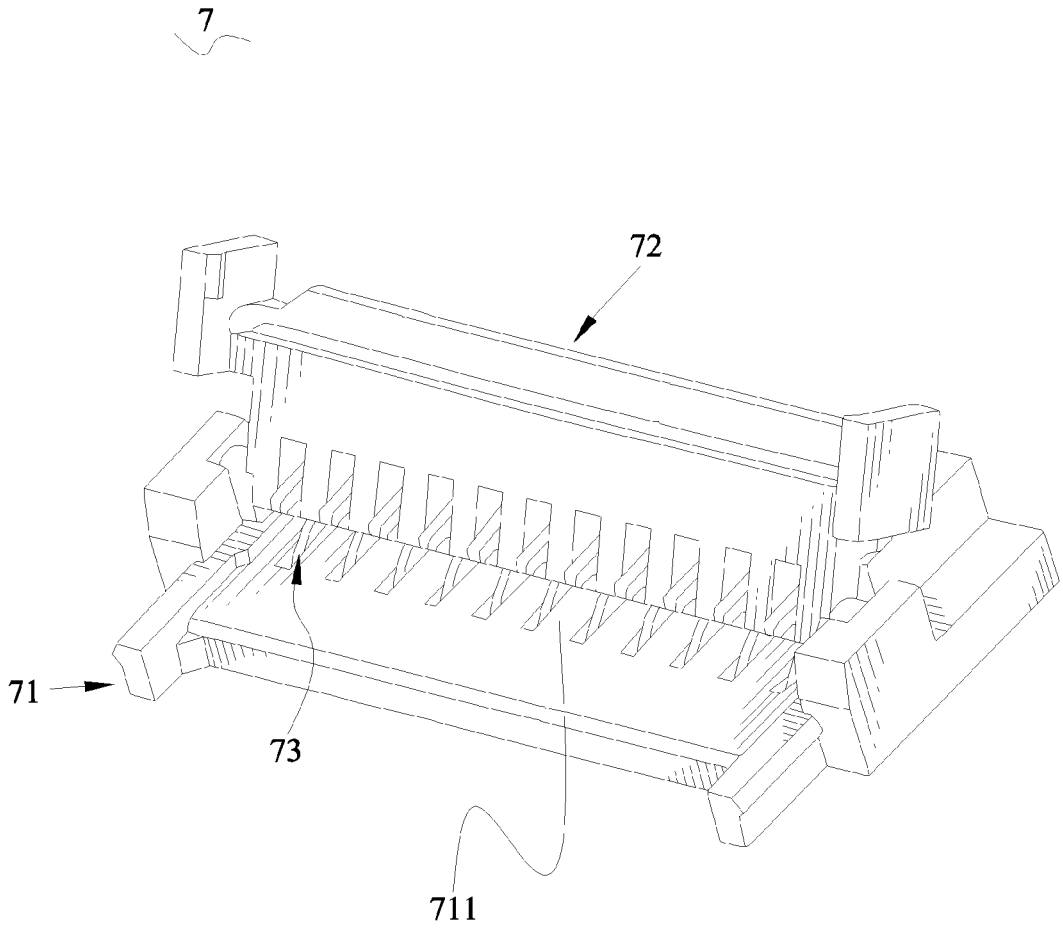
FIG. 9 (Prior Art)
FIG. 9 is a perspective view of a prior FPC connector.

Referring to FIG. 2 and FIG. 8, each of the fastening members 50 has a substantially lying-U shaped base frame which has a lower arm defined as a support bar 51 and an upper arm defined as a bearing arm 52 shorter than the support bar 51. A free end of the bearing arm 52 protrudes toward the support bar 51 to form a holding lump 53. A portion of the support bar 51 defines a notch 54 facing the holding lump 53. A free end of the support bar 51 is protruded downward to form a soldering tail 55.

Referring to FIG. 1 to FIG. 8, in assembly, the first electric terminals 30 are inserted forward with the first base arms 31 fastened in the corresponding first terminal passageways 19 and the first elastic arms 32 stretching into the receiving recess 15. The first soldering portions 35 are exposed out of the rear edge of the base board 11 of the insulating housing 10 for being soldered with a printed circuit board (not shown). The second electric terminals 40 are inserted rearward with the second base arms 41 fastened in the corresponding second terminal passageways 101 and the second elastic arms 42 stretching into the receiving recess 15. The fastening members 50 are inserted rearward with the support bars 51 fastened in the corresponding inserting grooves 102 of the insulating housing 10 and the bearing arms 52 stretching into the receiving recess 15. The elastic arms 32, 42 and the bearing arms 52 are further located under the elastic board 14 and the holding portion 18 leans upon the front of the elastic arms 32, 42 and the bearing arms 52. The soldering tails 55 and the second soldering portions 45 are exposed out of a front edge of the base board 11 of the insulating housing 10 for being soldered with the printed circuit board respectively. The first soldering portions 35 and the second soldering portions 45 are set at two opposite sides of the base board 11 of the insulating housing 10 and alternately arranged for strengthening the soldering between the FPC connector 1 and the printed circuit board. The shell 20 is mounted onto the insulating housing 10 by means of the buckling portions 26 being located into and then sliding forward along the corresponding assisting channels 103 until the positioning lumps 25 are positioned into the corresponding first positioning grooves 104.

Referring to FIG. 1 to FIG. 8 again, in use, when the FPC board 6 is fully inserted into the receiving recess 15 of the insulating housing 10 between the base arms 31, 41 and the elastic arms 32, 42 for electrically contacting the contact portions 34, 44, the shell 20 is further pushed forward until the positioning lump 25 is positioned in the second positioning groove 105. In process of the shell 20 being pushed forward, the pressing rib 22 of the shell 20 slides along the guiding slope 17 onto the top surface 16 of the elastic board 14 and presses the elastic board 14 downward to make the holding portion 18 further press the elastic arms 32, 42 downward so as to firmly clip the FPC board 6 by means of the contact portions 34, 44 and the interference portions 33, 43 and further ensure a steady electrical connection between the FPC board 6 and the electric terminals 30, 40. When the shell 20 is fully mounted onto the insulating housing 10, the preventing boards 27 are set at two opposite sides of the insulating housing 10 for avoiding electromagnetic interference from external environment. Furthermore, the bearing arms 52 of the two fastening members 50 are also pressed downward by the holding portion 18 so as to further firmly clip the FPC board 6 by means of the holding lumps 53 and the notches 54. When the FPC board 6 is drawn out of the receiving recess 15 of the insulating housing 10, the shell 20 will push rearward to make the pressing rib 22 away from the top surface 16 of the elastic board 14 and the positioning lump 25 repositioned in the corresponding first positioning groove 104. At this moment, the elastic board 14 and the elastic arms 32, 42 are released with their own flexibilities so that facilitates the FPC board 6 to be drawn out. Moreover, the buckling portions 26 are slidably located in the corresponding assisting channels 103 so that can prevent the shell 20 from overturning in process of the shell 20 sliding.

As described above, the elastic board 16 of the insulating housing 10 is pressed downward by the pressing rib 22 of the shell 20 so as to further press the elastic arms 32, 42 against the FPC board 6 for ensuring a steady electrical connection between the FPC board 6 and the electric terminals 30, 40.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for receiving a longitudinally inserted flexible printed circuit board therein, comprising:

an insulating housing having a base board, a rear end of the base board protruding upward to form a preventing wall extending transversely, a top of the preventing wall extending forward to form an elastic board suspended over the base board with a receiving recess formed therebetween for receiving the flexible printed circuit board therein;

a plurality of electric terminals disposed in the insulating housing in a transverse row, each of the electric terminals having a lying-U shaped base frame which has a lower arm defined as a base arm and an upper arm defined as an elastic arm, the base arm being disposed in the base board and the elastic arm stretching into the receiving recess under the elastic board, the flexible printed circuit board being inserted between the base arms and the elastic arms for electrically connecting the electric terminals;

a shell mounted onto the insulating housing along the insertion and withdrawal direction of the flexible printed circuit board and having a top board, a portion of the top board protruding downward to form at least one pressing portion pressing against and slidably moving along a top surface of the elastic board for pressing the elastic board downward so as to further press the elastic arms against the flexible printed circuit board; and a pair of fastening members located at two ends of the base board, each of the fastening members having a lying-U shaped base frame which has a lower arm defined as a support bar and an upper arm defined as a bearing arm, the support bar being disposed in the base board and the bearing arm stretching into the receiving recess under the elastic board for being pressed downward by the elastic board to secure the flexible printed circuit board;

wherein a free end of the bearing arm protrudes toward the support bar to form a holding lump against the flexible printed circuit board, and the support bar defines a notch facing the holding lump.

2. The connector as claimed in claim 1, wherein the elastic board has a top surface higher than the preventing wall, and a guiding slope is formed to connect the preventing wall and the elastic board.

3. The connector as claimed in claim 2, wherein a front end of the elastic board protrudes downward to form a holding portion to the insertion direction of the flexible printed circuit board to press the elastic arms downward against the flexible printed circuit board.

4. The connector as claimed in claim 1, wherein a free end of the elastic arm protruding downward to form a contact portion and a free end of the base arm protrudes toward the elastic arm to form an interference portion, the flexible printed circuit board is further clipped between the contact portions and the interference portions and electrically connecting the contact portions.

5. The connector as claimed in claim 1, wherein two opposite ends of the base board extending upward to form a pair of sidewalls each extending along the insertion direction of the flexible printed circuit board, a rear end of an outside of the sidewall defines at least first and second positioning grooves, two opposite end edges of the top board of the shell extend downward to form a pair of sideboards, a rear end of each of the sideboards protrudes inward to form a positioning lump sliding from the first positioning groove into and positioned in the second positioning groove.

6. The connector as claimed in claim 5, wherein a bottom of the outside of each sidewall defines an assisting channel extending along the insertion direction of the flexible printed circuit board to pass through a rear edge of the sidewall, each sideboard extends downward and then is bent inward to form a buckling portion slidably located in the corresponding assisting channel.

7. The connector as claimed in claim 6, wherein both a rear edge and a front edge of the top board extend downward to form a pair of preventing boards located in the insulating housing therebetween.

8. The connector as claimed in claim 1, wherein the pressing portion is defined as a rib extending transversely to be substantially perpendicular to the insertion direction of the flexible printed circuit board.

9. The connector as claimed in claim 1, wherein the electric terminals disposed in the insulating housing in the transverse row have respective soldering portions alternately formed at front ends and rear ends of the base arms of the lying-U shaped base frame for respectively being exposed from a front and a rear of the insulating housing to ensure a stable soldering.

10. A connector adapted for receiving a longitudinally inserted flexible printed circuit board therein, comprising:

an insulating housing having a base board, a rear end of the base board protruding upward to form a preventing wall extending transversely, a top of the preventing wall extending forward to form an elastic board suspended over the base board with a receiving recess formed therebetween for receiving the flexible printed circuit board therein;

a plurality of electric terminals disposed in the insulating housing in a transverse row, each of the electric terminals having a lying-U shaped base frame which has a lower arm defined as a base arm and an upper arm defined as an elastic arm, the base arm being disposed in the base board and the elastic arm stretching into the receiving recess under the elastic board, the flexible printed circuit board being inserted between the base arms and the elastic arms for electrically connecting the electric terminals; and a shell mounted onto the insulating housing along the insertion and withdrawal direction of the flexible printed circuit board and having a top board, a portion of the top board protruding downward to form at least one pressing portion pressing against and slidable moving along a top surface of the elastic board for pressing the elastic board downward so as to further press the elastic arms against the flexible printed circuit board;

wherein two opposite ends of the base board extending upward to form a pair of sidewalls each extending along the insertion direction of the flexible printed circuit board, a rear end of an outside of the sidewall defines at least first and second positioning grooves, two opposite end edges of the top board of the shell extend downward to form a pair of sideboards, a rear end of each of the sideboards protrudes inward to form a positioning lump sliding from the first positioning groove into and positioned in the second positioning groove, and wherein a bottom of the outside of each sidewall defines an assisting channel extending along the insertion direction of the flexible printed circuit board to pass through a rear edge of the sidewall, each sideboard extends downward and then is bent inward to form a buckling portion slidably located in the corresponding assisting channel.

11. The connector as claimed in claim 10, wherein the elastic board has a top surface higher than the preventing wall, and a guiding slope is formed to connect the preventing wall and the elastic board.

12. The connector as claimed in claim 11, wherein a front end of the elastic board protrudes downward to form a holding portion to the insertion direction of the flexible printed circuit board to press the elastic arms downward against the flexible printed circuit board.

13. The connector as claimed in claim 10, wherein a free end of the elastic arm protruding downward to form a contact portion and a free end of the base arm protrudes toward the elastic arm to form an interference portion, the flexible printed circuit board is further clipped between the contact portions and the interference portions and electrically connecting the contact portions.

14. The connector as claimed in claim 10, wherein both a rear edge and a front edge of the top board extend downward to form a pair of preventing boards located in the insulating housing therebetween.

15. The connector as claimed in claim 10, further comprising a pair of fastening members located at two ends of the base board, each of the fastening members having a lying-U shaped base frame which has a lower arm defined as a support bar and an upper arm defined as a bearing arm, the support bar being disposed in the base board and the bearing arm stretching into the receiving recess under the elastic board for being pressed downward by the elastic board to secure the flexible printed circuit board.

16. The connector as claimed in claim 10, wherein the pressing portion is defined as a rib extending transversely to be substantially perpendicular to the insertion direction of the flexible printed circuit board.

17. The connector as claimed in claim 10, wherein the electric terminals disposed in the insulating housing in the transverse row have respective soldering portions alternately formed at front ends and rear ends of the base arms of the lying-U shaped base frame for respectively being exposed from a front and a rear of the insulating housing to ensure a stable soldering.

* * * * *